US005136729A

United States Patent [19]

Ricard

[11] Patent Number: 5,136,729

[45] Date of Patent: Aug. 11, 1992

[54] ODOR REMOVER DEVICE

[76] Inventor: Vernon F. Ricard, Rte. 2, Crookston, Minn. 56716

[21] Appl. No.: 669,474

[22] Filed: Mar. 14, 1991

[51] Int. Cl.[5] ..... E03D 9/052

[52] U.S. Cl. ..... 4/213; 4/348

[58] Field of Search ..... 4/213, 216, 217, 218, 4/219, 347–352

[56] References Cited

U.S. PATENT DOCUMENTS 1,862,085 6/1932 Hertzog ..... 4/213

2,183,897 12/1939 Stiller ..... 4/213 X 4,882,790 11/1989 Ricard ..... 4/217 X

*Primary Examiner*—Charles E. Phillips

*Attorney, Agent, or Firm*—Herman H. Bains

[57] ABSTRACT

An odor removing device for toilets includes an odor collector secured to the conventional hinge posts of a toliet bowl. The odor collector has a single inlet opening and is connected in communicating relation to a downwardly convex auxiliary venturi housing which overlays the conventional bathroom ceiling fan. An air stream is introduced centrally into the auxiliary venturi and produces a venturi effect to thereby cause rapid evacuation of the noxious gases, steam and the like.

2 Claims, 1 Drawing Sheet

O
CF
C
32
31
12
35
34
30
29
W
27
28

WS
16
19
HP
20
13
25
26
23
24
11
TB
2

37a
34a
32a
30a
36a
33a
35a
35b
12a 11
17
14
15
22
18
TB 44
40
45
47
48
49
41
46
42
43

33
37
36
32
57

ODOR REMOVER DEVICE

FIELD OF THE INVENTION

This invention relates to odor removing attachments for conventional toilets.

BACKGROUND OF THE INVENTION

Various types of devices for ventilating toilets are embodied in various prior art patents. These prior art patents include U.S. Pat. Nos. 4,251,888; 4,174,545; 4,094,023; 3,600,724; 4,007,498; 4,301,555; 4,617,687; 2,172,506; 2,240,094; 3,491,382; and Swiss Patent 440,158.

These prior art patents are best characterized generally by an oval shaped gas collector mounted on or adjacent the toilet seat and through which the gases are directed. A separate exhaust fan is provided and is connected in communicating relation to the gas collector. In some instances, the toilet bowl itself is constructed to define an oval shaped gas collector. In all instances, the exhaust fan is separately provided.

In my U.S. Pat. No. 4,882,790, I have provided an odor removing device which includes a perforated L-shaped gas collector attached to the lower surface of a toilet seat. An auxiliary housing is applied to and covers the conventional ceiling fan and is connected to the gas collector by conduit. Malodorous gases are evacuated when the fan is energized. This device takes advantage of the conventional ceiling fan and is therefore a departure from the devices disclosed in the prior art patents previously referred to.

Although the odor removing device disclosed in my U.S. Pat. No. 4,882,790 serves to remove noxious odors, it has been found that the operational efficiency device should be improved. The present invention increases the efficiency of the odor removing function without requiring a specially designed or more powerful ceiling fan.

SUMMARY OF THE INVENTION

An object of this invention is to provide an odor removing attachment for use with toilets which includes a gas collector connected in communicating relation to an auxiliary venturi housing applied to the ceiling fan. The gas collector includes an intake member having a single inlet for efficiently collecting noxious gases. One embodiment of the auxiliary venturi housing includes an inverted frustro-conical member having an attachment plate secured thereto and extending outwardly therefrom. The inverted frustro-conical member has an open lower end and is provided with a fitting connected in communicating relation to the gas collecting member by a conduit.

In another embodiment the auxiliary venturi housing includes an annular wall having a downwardly convex bottom wall secured to the side wall. The bottom wall has central opening therein and a venturi effect is produced with respect to the gas stream directed through the conduit into the auxiliary venturi housing. When the ceiling fan is energized, noxious gases will be directed through gas collector, conduit and then through the auxiliary venturi housing. The configuration in both embodiments of the auxiliary fan housing produces a venturi effect for increasing the velocity of the noxious gases being exhausted by the ceiling fan.

FIGURES OF THE DRAWING

DESCRIPTION OF THE PREFERRED EMBODIMENT

Figures 1, 1A, 2, 3, 4, 5:
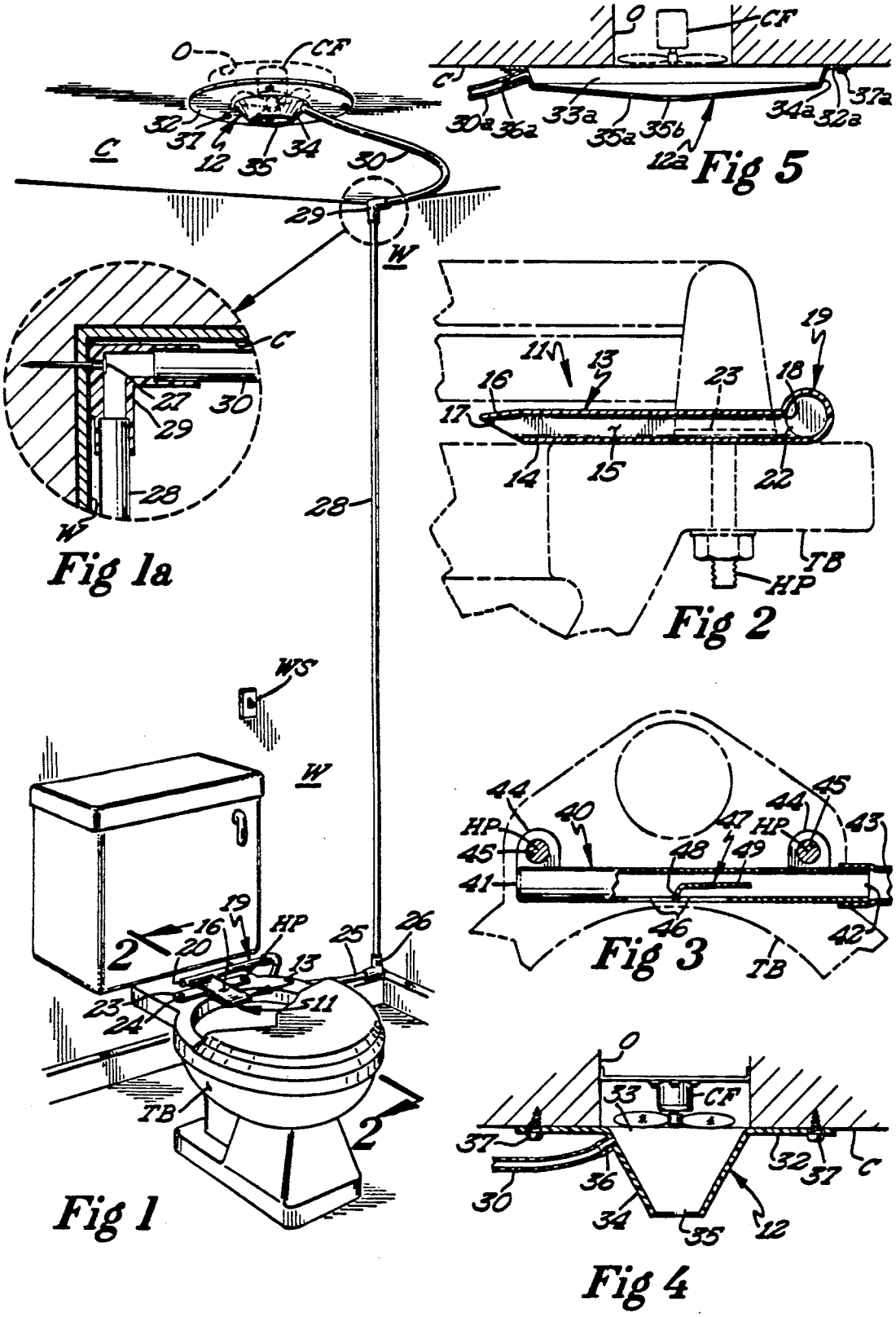
FIG. 1 is a perspective view of a conventional residential bathroom illustrating a conventional toilet incorporating my improved odor attachment.
FIG. 1*a* is an enlarged fragmentary cross-sectional view of a component of the improved odor removing attachment.
FIG. 2 is a cross-sectional view taken approximately along line 2—2 of FIG. 1 and looking in the direction of the arrows.
FIG. 3 is a top plan view of a different embodiment of the gas collector with certain parts thereof broken away for clarity.
FIG. 4 is a cross-sectional view of the auxiliary venturi housing.
FIG. 5 is a cross-sectional view similar to FIG. 4 but illustrating a different embodiment of the auxiliary for housing.

Referring now to the drawing it will be seen that the novel odor removing attachment, designated generally by the reference numeral 10, is illustrated as being attached to a conventional toilet typically found in residential bathrooms. The bathroom includes a ceiling C having an opening O therein for accommodating a conventional low powered ceiling fan CF. The bathroom includes vertical walls W, one of which has a wall switch WS for controlling operation of the bathroom lights and the ceiling fan CF. The toilet is of conventional construction and includes a toilet bowl TB to which the toilet seat is hinged. The hinges for the toilet seat includes conventional hinge posts HP which are of well known construction.

The odor removing attachment 10 includes an odor collector 11 which is mounted on the upper surface of toilet bowl TB adjacent the rear thereof and is connected in communicating relation to an auxiliary venturi housing 12 by suitable conduits. The odor collector 11 includes an intake member 13 which is of generally elongate rectangular configuration and includes a flat lower wall 14, opposed flat side walls 15, and a flat upper wall 16. The intake member 13 has an open front end 17 which defines an inlet and an open rear end 18 which defines an outlet.

The odor collector also includes an elongate substantially straight coupling element 19 which is in the form of a short pipe having a closed end 20 and an open 21 and an elongate inlet slot 22 therein. The coupling element 19 is rigidly secured to a rear end portion of the intake member 13 and projects laterally from one side thereof. The inlet slot 22 is disposed in registering relation with the rear outlet opening 18 in the intake member. The odor collector also includes an elongate substantially flat bracket 23 which is rigidly secured to the intake member at its lower wall, and the bracket 23 has a pair of openings 24 therein that fit over the hinge post HP secured to the toilet bowl TB.

The odor collector 11 may be formed of a rigid plastic material in a moulding operation or it may be formed of a suitable metal such as aluminum or the like. When the odor collector 11 is secured to a toilet, it will be positioned below the toilet seat and upon the upper surface of the toilet bowl TP adjacent the rear thereof as best seen in FIG. 2. Therefore the installation and attachment of the odor collector to the toilet bowl TB does not effect the construction or functioning of any of the components of a conventional toilet. It will be noted that the lower wall 14 engages the upper surface of the toilet bowl TB at the rear portion thereof, and that the side walls 15 are spaced inwardly from the outer periphery of the toilet bowl.

One end of an elongate flexible conduit 25 is connected to the outer or free end of the coupling element 19 and the other end of the conduit 25 is connected to a lower rigid elbow 26. The rigid elbow 26 may be formed of a suitable plastic material and is secured to the adjacent vertical wall W by fastening element (not shown) such as a screw or nail or the like. In this regard, the elbow 26 has an opening therein to accommodate the fastening element.

One end of an elongate rigid conduit 28 is secured to the lower elbow 26 and the other end of this rigid conduit is connected to an upper rigid elbow 29. The upper elbow 29 is secured to the adjacent vertical wall W by fastening element 27 as best seen in FIG. 1*a*. The lower elbow 26 is secured to the adjacent wall in the identical manner as the upper elbow 29.

An elongate conduit 31 interconnects the elbow 29 to the auxiliary venturi housing 12. It will be seen that no brackets or other support elements are needed to support the conduit components of the odor removing attachment.

The auxiliary venturi housing 12 is of downwardly convex configuration and has a circular flat rigid mounting flange 32 secured to an inverted frustro-conical member 34 and extending radially outwardly therefrom. The venturi housing overlies the ceiling fan CF so that the open upper end of the frustro-conical member 34 is disposed in registering relation with the ceiling fan opening O. The frustro-conical member 34 has an open lower end 35. It will be noted that the frustro-conical member 34 has a fitting 36 integrally formed therewith and projecting outwardly therefrom to which the conduit 30 is connected. The rigid circular flange 32 is secured to the ceiling C by suitable fastening elements 37 such as nails, screws and the like. It will also be noted that the surface area of the flange is substantially larger than the surface area of the central opening 33 therein.

It will be noted that when the odor collector 11 is secured to the toilet bowl TB, the odor collector is generally centrally positioned with respect to the toilet bowl TB. It will also be noted that the end of the intake member 13 projects outwardly beyond the rear edge portion of the toilet bowl. Finally, it will be noted that the upper wall 16 of the intake member 13 projects outwardly beyond lower wall 14 to prevent the inadvertent entry of fluid material into the intake member from above.

During operation of the odor removing attachment 10, the ceiling fan CF will be operated when the wall switch WS is closed. Malodorous gases will pass through the intake member into the conduit 25, conduit 28, conduit 30 and to the inverted frustro-conical housing number 34. Air will also be introduced into the inverted frustro-conical member 34 through the lower opening 35 therein. The downwardly tapered configuration of the frustro-conical member 34 produces a venturi effect as the air flows through the restricted opening 35. The stream of gases passing through the conduits and through the fitting 36 to the frustro-conical member will have its velocity increased by the venturi effect of the air flowing through the restricted opening 35.

Therefore the evacuation of the gases is accelerated by this unique construction of the auxiliary venturi housing 12. The gases also enter the odor collector 11 through a single elongate opening in the intake member 13 which also decreases the time in which the gases are evacuated as compared to the prior art devices. It has also been found that steam will be rapidly removed from the bathroom by the venturi action of the air as it passes through the opening 35 in the auxiliary venturi housing.

Referring now to FIG. 3, it will be seen that a different embodiment of the odor collector is thereshown and is designated generally by the reference numeral 40. It will be seen that the odor collector 40 is of straight elongate, preferably tubular construction and is also formed of a suitable rigid material such as a rigid plastic or metal. The odor collector 40 has a closed end 41 and an open end 42 which is connected in communicating relation to a conduit 43. The conduit 43 corresponds in size and function to the conduit 25 in the embodiment of FIG. 1 and the open end 42 comprises the outlet of the odor collector. The longitudinal axis of the odor collector 40 extends transversely of the toilet bowl.

The odor collector 40 is also provided with a pair of longitudinally spaced apart ears 44 integrally formed therewith, each having an opening 45 therethrough. These apertured ears 44 permit the odor collector to be positioned upon the hinge posts HP of the conventional toilet. The odor collector 40 also has an elongate longitudinally extending slot 46 therein which corresponds in size to the inlet opening 17 of the odor collector 11. A rigid L-shaped baffle 47 is positioned within the odor collector 40 and includes a rigid arm 48 and an arm 49.

It will be noted that the arm 48 is centrally located with respect to the elongate inlet slot 46 and projects rearwardly therefrom. The rigid arm 49 is located in approximately the longitudinal center line plane of the odor collector 40 and projects towards the open end 42 of the odor collector. It will be noted that the end of the arm 49 projects longitudinally beyond the adjacent end edge of the elongate slot 46.

It is pointed out that the odor collector 40 uses the same conduit components and the same auxiliary venturi housing as illustrated in the embodiment of FIG. 1. During operation of this embodiment of the odor collector 40, gases will pass through the elongate inlet slot 46 and thereafter through the conduit 43 and the other conduit components and will be exhausted through the auxiliary venturi housing with a venturi effect in the manner of the embodiment of FIG. 1. The particular configuration of the odor collector 40 is required when the odor removing attachment is used with institutional bathrooms. The construction of each institutional toilet requires the odor collector 40 to have a configuration as illustrated in FIG. 5.

Testing has indicated that if no baffle is provided, the gases within the toilet bowl will not be evacuated evenly through the elongate inlet slot 46. As viewed in FIG. 5, the gases located in the right zonal area of the toilet bowl will simply not be removed because of the dynamics produced by the inflow of such gases into the gas collector. However, the L-shaped baffle permits gases to be drawn evenly into the odor collector and rapidly evacuated from the toilet bowl in the manner of the embodiment of FIG. 1.

Referring now to FIG. 5, it will be seen that a different embodiment of the auxiliary venturi housing, designated generally by the reference numeral 12*a*, is thereshown. The auxiliary venturi housing 12*a* is of downwardly convex configuration and includes an annular wall 34*a* having a downwardly convex bottom wall 35*a* integral therewith. The venturi housing 12*a* also has an out turned flange 37*a* integral with the annular wall 34*a* and extending radially therefrom. The bottom wall 35*a* has a central opening 35*b* therein, and the annular wall has a tubular fitting 36*a* integrally formed therewith for connection to the conduit 30*a*.

It is pointed out that conduit 30*a* is connected by the same conduit components as illustrated in FIGS. 1 to 4 to an odor collector secured to the toilet bowl. It is further pointed out that either embodiment of the odor collector 11 or 40 maybe used with the auxiliary venturi housing 12*a*. It will be noted that the annular wall 34*a* tapers downwardly towards the bottom wall 35*a*, while the latter tapers slightly downwardly and inwardly towards the central opening 35*b* therein. During operation of the odor removing attachment which utilizes the auxiliary venturi housing of FIG. 5, gases will be directed into the conduits from the odor collector 11 or 40 and eventually into the auxiliary venturi housing 13*a*. Air will simultaneously flow through the opening 35*b* and thereby create a venturi effect with respect to the gas stream. Therefore the gas stream velocity is increased to rapidly exhaust the noxious odors.

The odor removing attachment 10 is preferably sold as a kit and may be readily installed without requiring any specialized tools. The attachment takes advantage of the conventional ceiling fan normally present in residential bathrooms. Because of the unique construction of the auxiliary venturi housing 12, these conventional low powered ceiling fans not only may be used to remove the odors but the venturi effect permits odors, steam and the like to be rapidly removed from the bathroom.

Thus it will be seen that I have provided an improved odor removing attachment, which is not only of simply and inexpensive construction, but one which functions in a more efficient manner than any heretofor know comparable device.

What is claimed is:

1. An odor removing attachment for use with a toilet positioned in a bathroom having vertical walls and having a ceiling, a conventional ceiling fan mounted in an opening in the coiling for exhausting gases therethrough, a switch mounted on a vertical wall in the bathroom for energizing the coiling fan, the toilet including a toilet bowl having an upper surface, an oval-shaped toilet seat, hinges hingedly connecting the toilet seat to the toilet bowl including a pair of hinge posts projecting upwardly from the toilet bowl adjacent the rear portion thereof, said odor removing attachment comprising, an elongate, straight tubular odor collector having an open end and a closed end and being positioned upon the upper rear surface of the toilet bowl, said open end defining an outlet, said odor collector having a single elongate longitudinally extending forwardly facing slot therein, an L-shaped baffler positioned within said odor collector at said slot including a first arm located centrally of the elongate slot and a second arm extending longitudinally of the odor collector, said L-shaped baffle cooperating with said slot for causing gases to be directed uniformly from the toilet bowl into the odor collecposts on the toilet bowl, elongate conduit means having one end thereof connected in communicating relation to the outlet of the odor collector, a downwardly convex auxiliary venturi housing secured to the coiling in overlying relation to the ceiling fan, said venturi housing having a centrally located opening therein, means connecting the the end of said conduit means to said housing whereby when the fan is energized, gases will be moved through the odor collector conduit means, into the venturi housing, and whereby air will be simultaneously moved through the central opening in the venturi housing to produce a venturi effect to thereby increase the velocity of the gases passing through the conduit and through the coiling fan.

2. The odor removing attachment as defined in claim 1 wherein said venturi housing has a downwardly tapered annular wall and a downwardly convex lower wall integral with said annular wall, said lower wall having said central opening therein, and a fitting secured to said annular wall for connection to said conduct means.

* * * * *